United States Patent [19]

Schwarze

[11] 4,416,136

[45] Nov. 22, 1983

[54] PIPE-BENDING MACHINE

[76] Inventor: Rigobert Schwarze, Olpener Str. 460-474, 5000 Köln 91, Fed. Rep. of Germany

[21] Appl. No.: 298,753

[22] Filed: Sep. 2, 1981

[30] Foreign Application Priority Data

Sep. 4, 1980 [DE] Fed. Rep. of Germany ..... 3033300

[51] Int. Cl.[3] ..... B21D 7/04

[52] U.S. Cl. ..... 72/157; 72/159

[58] Field of Search ..... 72/149, 150, 154, 155, 72/156, 157, 158, 159

[56] References Cited

U.S. PATENT DOCUMENTS 4,038,853 8/1977 Schwarze ..... 72/157
4,236,398 12/1980 Schwarze ..... 72/157

FOREIGN PATENT DOCUMENTS 1174598 7/1964 Fed. Rep. of Germany ..... 72/157
2101162 7/1972 Fed. Rep. of Germany ..... 72/157
295153 2/1954 Switzerland ..... 72/149
306275 6/1955 Switzerland ..... 72/157
421667 4/1967 Switzerland ..... 72/149

*Primary Examiner*—Ervin M. Combs
*Attorney, Agent, or Firm*—Michael J. Striker

[57] ABSTRACT

A pipe-bending machine has a bending table rotatable about an axis of rotation, a bending form having two opposite curved sections each defining a center of curvature, an oblong hole connecting the two centers of curvature, a retaining bolt coaxial with the axis of rotation of the table and projecting above the upper surface of the latter to engage the oblong hole, and means for shifting the bending form from one working position in which one center of curvature coincides with the axis of rotation of the table into another working position in which the other center of curvature coincides with the axis of rotation, and means for arresting the bending form in its selected working position.

12 Claims, 10 Drawing Figures

PIPE-BENDING MACHINE

BACKGROUND OF THE INVENTION

The present invention relates in general to pipe-bending machines, and in particular to a pipe-bending machine having a rotatable bending table provided with a bending form and with a clamping jaw movable toward and away from the bending form, a stationary machine stand supporting for free longitudinal displacement a feeding carriage with an adapter sleeve rotatable about its center axis and having an opening device; the bending form and the clamping jaw are provided, respectively, with two juxtaposed peripheral grooved sections of different curvatures, both the bending form and the clamping jaw being rotatably mounted on the bending table and being coupled to assigned driving means which adjust the matching curved grooves in the form and in the jaw to face each other.

A pipe-bending machine of the aforedescribed type is known from the German published patent application No. 26 26 202. In this known design, the bending form and the corresponding clamping jaw have clamping surfaces in the form of a rectilinear groove cooperating with one or more curved clamping grooves the radius of which corresponds to the radius of the processed pipe; driving means for adjusting the angular positions of the form and the clamping jaw relative to the bending table are assigned both to the jaw and to the form in such a manner that the rectilinear grooves or the curved grooves lie opposite each other. This prior-art bending machine, designed by the same inventor as in the present invention, fulfills the objective to bend in a single working cycle the pipe into several arcs without intermediate rectilinear lengths. In other words, the pipes in this prior-art machine are clamped at a single adapter sleeve, whereupon the pipe arc produced by one curved section of the bending form immediately adjoins the pipe arc produced by the other curved section of the form. Both successive pipe arcs in this solution have the same radius of bending. The solution according to the German published patent application No. 26 26 202 has proved successful in practice and in comparison with other pipe-bending machines known in the art has a significantly reduced number of component parts resulting in substantially easier operation. The disadvantage of this solution, however, is the fact that during a single clamping in the adapter sleeve different bending radii could not be attained.

In bending pipes it has been generally sought to make consecutive pipe arcs with the same radii of curvature so as to avoid the exchange of bending forms during the bending process on one pipe. There are, however, many instances when a single bending radius cannot be employed or is undesirable. For example, it is frequently desirable that in bending muffler pipes for motor vehicles a bending radius is to be used at which the muffler pipe reproduces a certain dynamic gas pressure. This particular bending radius, however, cannot be used advantageously for making the subsequent pipe arcs.

From the German published patent application No. 21 01 162, it is also known to bend pipes on a fully automatic, digitally controlled bending machine of the aforedescribed type so that several different bending radii can be made without the exchange of bending forms or without the readjustment of the clamping point in the feeding adjuster sleeve. For this purpose, there are provided on the bending table several bending forms of different diameters, the forms being coaxially superposed and arranged at different levels. In adjusting the pipe to another bending form the adapter sleeve clamping a portion of the pipe is lifted or lowered on the feeding carriage so as to align the pipe with the selected bending form. In this manner, the bending of pipes with different bending radii takes places at different levels. The disadvantage of this arrangement, however, is that the vertical adjustment of the adapter sleeve relative to the feeding carriage cannot be made with sufficient speed inasmuch as the weight of the adapter sleeve with the clamped pipe is too large. Also the apparatus expenditures are considerable.

From U.S. Pat. Nos. 3,299,681 and 3,147,792 there are known similar arrays of bending forms arranged at different levels. In changing the pipe from one bending form to another the desired bending form is brought into a corresponding vertical position by means of a spindle. It is true that in this solution the bending of the pipe occurs always at the same level, but again the lifting or lowering of the whole pack of bending forms by means of a spindle requires a relatively long time, and the machine in the range of the bending forms is too bulky.

In order to perform the bending operation always at the same vertical position relative to the bending table while achieving a fast exchange of the bending form, in the German published patent application No. 27 46 721 it has been devised that the bending forms are axially adjustable relative to each other, whereby in the starting position the outer bending form surrounds an inner bending form. In this manner, a very accurate bending of pipes into arcs of different radii is made possible, particularly on digitally controlled pipe-bending machines. Such machines have proved to be successful; nonetheless, due to the coaxial arrangement of bending forms, a certain discontinuity or difference is always present in the range of radii to be selected.

In the solution according to the above-mentioned published patent application No. 26 26 202 it is possible to bend the pipe into successive arcs of the same bending radius without intermediate straight lengths; the solution according to the German published patent application No. 27 46 721 enables the bending of pipes at different bending radii and with straight intermediate lengths between the arcs.

SUMMARY OF THE INVENTION

A general object of this invention is to provide an improved pipe-bending machine which makes it possible to produce in a single working cycle pipe arcs of the same or different radii with or without straight lengths between the successive arcs.

In keeping with these objects and others which will become apparent hereafter, one feature of the invention resides in the provision of the bending machine of the aforementioned type but in which both the bending form and the assigned clamping jaw are displaceably mounted on the bending table to move at the level of the bending table relative to each other, and the bending form is additionally displaceable independently of its rotary movement to bring one or the other of its curved surfaces opposite the clamping jaw.

When the form is made with two opposite curved surfaces of different radii, the resulting asymmetric configuration of its periphery is compensated for by shifting and rotating the form at the level of the bending table until the corresponding clamping groove of the desired radius is brought into its working position opposite the clamping jaw.

Of particular advantage is the embodiment of this invention in which a retaining bolt projects above the upper surface of the bending table along the axis of rotation of the latter and engages an oblong hole in the bending form. The bending form is thus shiftable relative to the retaining bolt which is fixed relative to the axis of rotation of the bending table, and the oblong hole connects the centers of curvature of the opposite curved grooves on the peripheral sections of the form. This solution enables the use of exchangeable bending forms with different curved peripheral sections and with corresponding oblong holes or a conventional bending form without the oblong hole such as is conventional in prior-art solutions. Moreover, this embodiment enables also the operation according to the German published patent application No. 26 26 202 using a bending form and a clamping jaw having both straight and curved grooves on its periphery and being rotatable on the bending table so as the corresponding grooves on the form and on the jaw be opposite each other.

The machine of this invention, due to its particular support and drive for the bending form, enables a variety of bending forms of different bending radii to be employed. To achieve a fast exchange of the bending form preferably by means of digitally controlled devices during a single clamping operation on the machine stand, the displacement of the bending form provided with the oblong hole relative to the retaining bolt is made by means of a hydraulic or pneumatic device. Of particular advantage is a pneumatic control device which, according to still another embodiment of this invention, uses the retaining bolt itself as a pneumatic piston and the space bounded by the oblong hole as a pneumatic cylinder. In this case, the oblong hole is covered by a cover plate sealed by sealing strips, and the pneumatic connections are formed in the bolt itself.

In a further modification of the latter embodiment, the retaining bolt in the range of the oblong hole is flattened at two opposite sides to snugly fit the elongated walls of the hole. The flattened surfaces of the bolt not only ensure a sufficient contact surface between the bolt acting as a pneumatic piston and the guiding wall of the elongated hole acting as a pneumatic cylinder, but at the same time provide guiding surfaces which ensure a stable relative position of the form and the retaining bolt and transfer rotary movement of the bolt to the form.

In still another embodiment of this invention, the retaining bolt is inserted into a hollow shaft integrally connected to the rotary bending table and supporting a spur gear for a chain drive. The retaining bolt is secured to the hollow shaft by means of a locking key.

In order to hold the bending form in a selected angular position relative to the counteracting clamping jaw, in still another embodiment of this invention a retaining recess is provided both in the bending table and in the bending form to receive a displaceable key preferably in the form of a snugly fitting spring extending parallel to the flattened surfaces of the retaining bolt or to the elongated walls of the oblong hole, whereby during rotation of the form the wedging key is lowered into the bending table.

According to still another embodiment, the arresting key between the bending table and the bending form is controlled by a hydraulic device.

For the hydraulic or pneumatic displacement of the bending form relative to its retaining bolt, two parallel channels are formed in the bolt, of which one channel serves for feeding pressurized air into one pressure space between the bolt and the closed interior of the oblong hole, and the other channel serves for discharging the pressurized fluid from the opposite pressure space. With advantage, a sealing strip is recessed in each flattened surface portion of the retaining bolt. The intake and exhaust channels for the working fluid can be directed either downwardly through the retaining bolt or upwardly; in the latter case, the upper end of the bolt sealingly passes through a matching opening in the cover plate.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
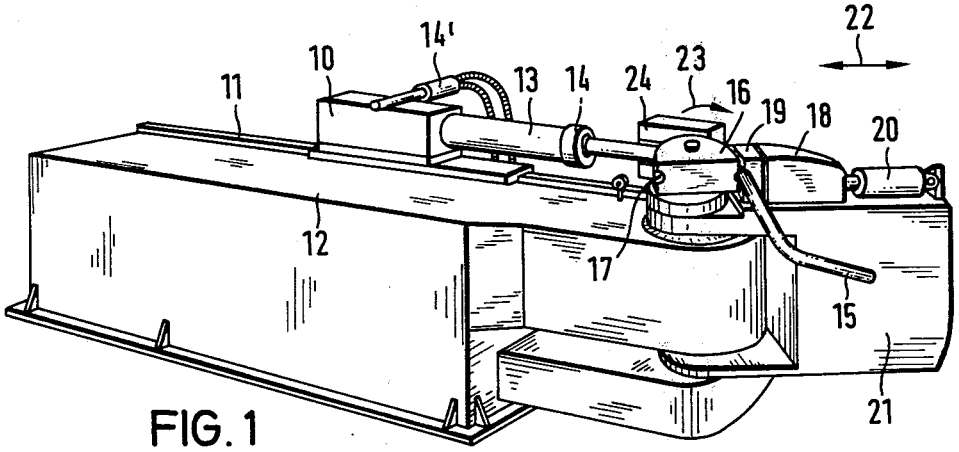
FIG. 1 is a perspective view illustrating a pipe-bending machine.

FIG. 1 shows in a perspective view a conventional pipe-bending machine, including a machine stand housing 12, a feeding carriage 10 movable on one or more guiding rails 11 on the upper surface of stand housing 12. The feeding carriage 10, which is freely movable in two opposite directions, supports a hollow cylinder 13 the interior of which houses a split taper or adapter sleeve 14 which clamps the trailing end portion of pipe 15 to be bent. The leading pipe portion is guided past a bending form 16, the center of curvature of which is positioned in the axis of rotation of rotatable bending table 21. The curved peripheral portion of the form 16 has a semicircular groove 17 matching the diameter of the processed pipe. A section of pipe 15 adjoining the curved surface of the bending form 16 is clamped by means of clamping device 18 and a clamping jaw 19 against the groove 17 of the bending form. Clamping jaw 19 is also provided with a semicircular groove matching the diameter of the processed pipe. Reference numeral 20 designates a hydraulic cylinder-and-piston unit hinged on the bending table 21 and coupled to the clamping device 18 to move the same toward and away from the form 16 in the direction of arrow 22. As mentioned before, bending form 16 is fixedly mounted on the rotatable table 21 at the axis of its rotation, and consequently when the curved peripheral portion of form 16 together with the clamping jaw 19 rotates in the direction of arrow 23, the clamped section of pipe 15 is bent into an arc corresponding to the curved profile of the bending form 16. During this bending process, the trailing end part of pipe 15 remains clamped in the adjuster sleeve 14 of the feeding carriage 13 so that the pipe in all positions thereof is positively guided. To prevent that the free pipe section between the adjuster sleeve 14 and the bending form 16 be not buckled, a sliding piece 24 engages this free portion of the pipe. The sliding rail or piece 24 can also be formed with a guiding groove corresponding in diameter to the processed pipe. The adjuster sleeve 14 on the feeding carriage 10 not only firmly clamps the end piece of pipe 15 but also is rotatable up to 360° when the successive pipe arcs are bent in different directions.

Figure 2:
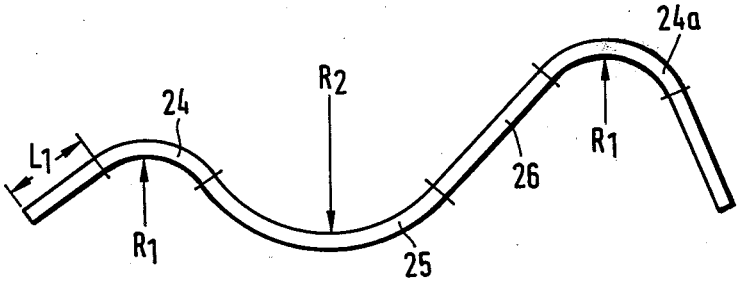
FIG. 2 shows a pipe produced by the machine of FIG. 1 with pipe arcs of different radii and including a straight intermediate pipe length.

FIG. 2 shows a bent pipe having one pipe arc 24 bent with a radius R1 and adjoining immediately another arc 25 with a radius R2 and connected via a straight pipe section 26 to a pipe arc **24*a* having again a radius R1**.

Figure 3:
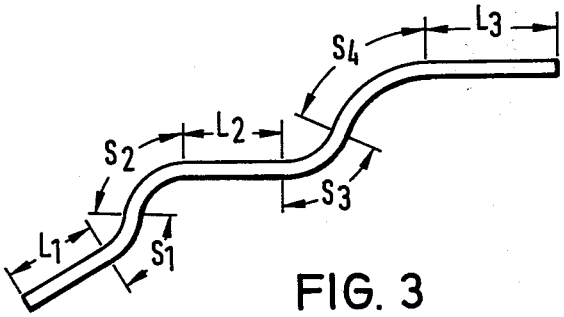
FIG. 3 is a pipe with successive arcs of different radii without the intermediate straight length.

FIG. 3 shows a different configuration of the bent pipe, in which sections S1, S2, S3 and S4 are bent into arcs of the same radii following directly one after the next and including also optional straight sections L1, L2 and L3.

Figure 4:
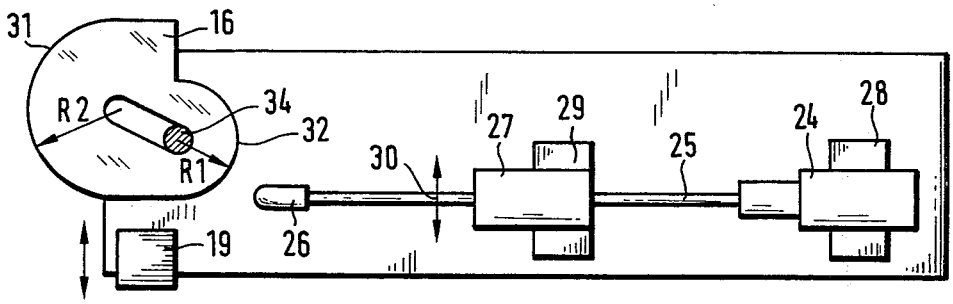
FIG. 4 is a schematic top view of the machine of FIG. 1 with a bending form adjusted in one angular position.

FIGS. 4–10 show the embodiment of the machine of this invention in which pipes according to FIGS. 2 and 3 with pipe arcs of different or the same radii are manufactured. FIG. 4 shows a frame of a pipe-bending machine substantially corresponding to that of FIG. 1, except that it includes a holder 24 with a mandrel 25 the front end of which supports a conventional adapting piece 26. The mandrel holder 24 as well as the adapter sleeve 27 are respectively supported on carriages 28 and 29 displaceable in two opposite directions indicated by double arrow 30 to adjust the processed pipe to different diameters of bending form 16. This mandrel, however, is optional and can be dispensed with. Bending form 16 of this invention illustrated in FIGS. 4 and 5 includes a semicircular peripheral section 31 of diameter R2 and another semicircular peripheral section 32 of a smaller diameter R1. The bending form 16 representing a single working tool for two different bending diameters arranged in a single plane parallel to the upper surface of the working table is, according to this invention, shiftably mounted between two extreme positions relative to the clamping jaw 19. As will be seen from the Figures, the bending form has an oblong hole 33 connecting the centers of curvature of opposite peripheral curved portions and being of a width corresponding to the diameter of a retaining bolt 34 projecting above the upper surface of the bending table, as will be described below.

Figure 5:
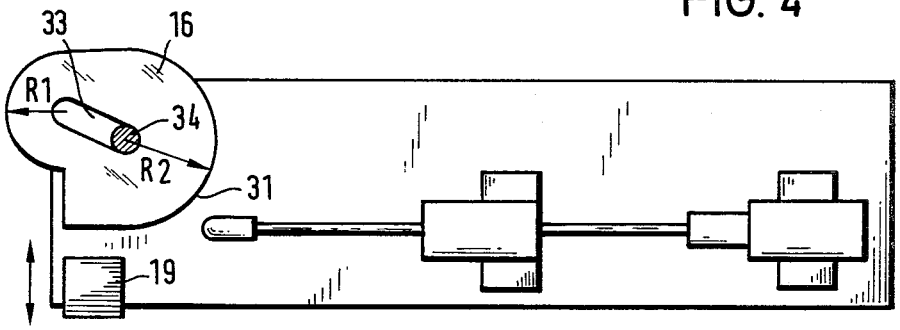
FIG. 5 is a view similar to FIG. 4 with the bending form in another position.

The bolt 34 is stationary relative to the bending table but is rotatable about its axis of rotation. Bending form 16 is thus shiftable in the direction of the oblong hole 33 and at the same time is rotatable about the central axis of the bolt 34, preferably jointly with the latter. FIG. 5 shows form 16 of FIG. 4 in the other working position. While in the first working position according to FIG. 4 the pipe is clamped between the straight clamping surfaces of the form 16 and of the clamping jaw 19 and, upon rotation of the bending table clockwise, the pipe is bent with a radius R1; in the other position according to FIG. 5, the larger curved section 31 with the larger radius R2 is effective.

Figure 6:
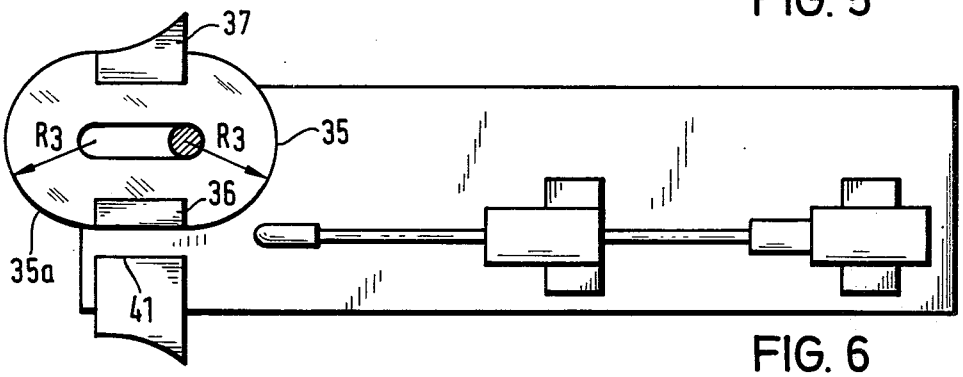
FIG. 6 is a view similar to FIG. 4 with a modified bending form and a corresponding clamping jaw shown in one position.

FIG. 6 illustrates a modified bending form having two curved surfaces 35 and **35*a* of the same radius of curvature R3 so that, independently of the working angular position and shifting of the bending form with respect to the retaining bolt 34, the resulting pipe arcs are of the same design as illustrated in FIG. 3, namely having an arc S1 with an immediately adjoining arcs S2 with straight sections produced by the straight clamping side 36 or by the curved clamping side 37** and corresponding substantially to that as produced according to the aforementioned German publication 26 26 202.

The bending form according to this invention can be provided with two or more sections of different bending radii arranged in a common plane so that, in order to bring a selected curved section into a working position, the form is shifted and simultaneously rotated on the bending table. It will be noted that the bending form illustrated in FIG. 6, apart from different clamping surfaces 36 and 37, may also have different radii of their curved sections.

Figure 7:
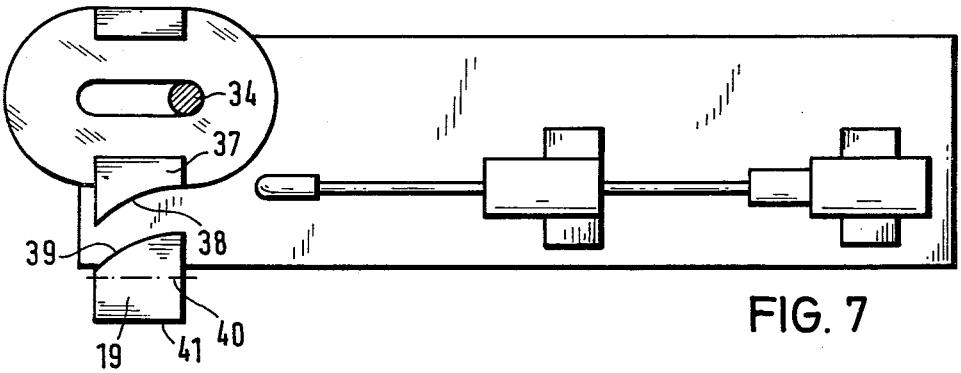
FIG. 7 is a view similar to FIG. 6 with a bending form and its clamping jaw in a different working position.

FIG. 7 shows the bending form of FIGS. 6 when angularly displaced by 180° about or with the bolt 34 and longitudinally displaced in the oblong hole 33. In all embodiments shown in FIGS. 4–7, the bolt 34 is stationary relative to the rotatable bending table. It will be explained later, however, that in another modification the retaining bolt 34 is itself rotatable about its center axis. In the position of FIG. 7, the curved surface 38 faces a correspondingly curved clamping surface 39 of jaw 19. Similarly as described in the German publication No. 26 26 202, the clamping jaw 19 is rotatable about a horizontal axis 40 so as to selectively adjust its straight clamping surface 41 or its curved clamping surface 39 opposite the bending form. Both of the clamping surfaces are formed with a clamping groove, the diameter of which matches the diameter of the processed pipe.

Figure 8:
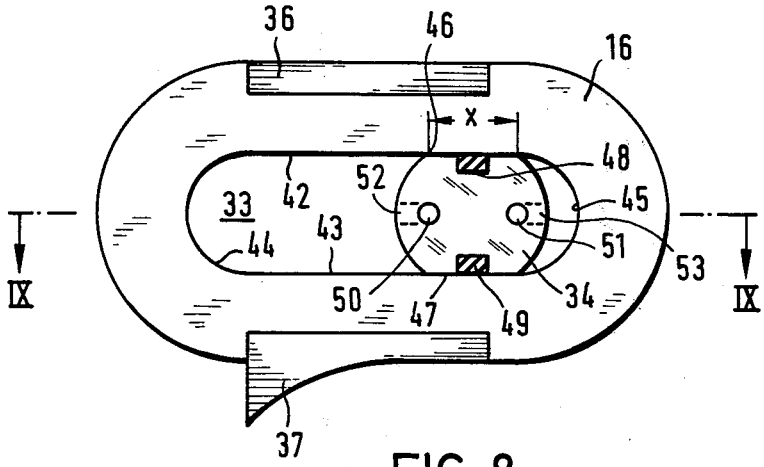
FIG. 8 shows on an enlarged scale the bending form of FIG. 7 with a modified version of its driving bolt.
Figure 9:
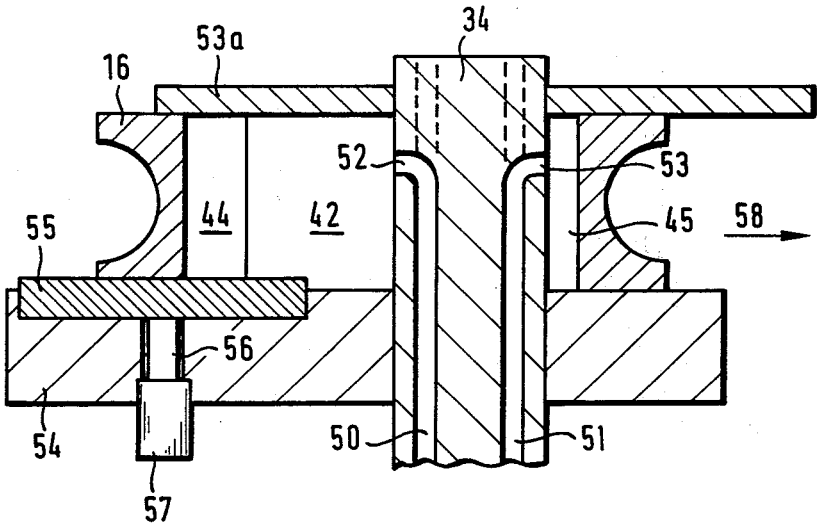
FIG. 9 is a sectional side view of the bending form of FIG. 8, taken along the line IX—IX and shown on an enlarged scale.

FIGS. 8 and 9 show in greater detail a bending form similar to that of FIG. 6. The oblong hole 33 connecting the centers of curvature of the opposite curved surfaces of the form defines two opposite longitudinal and flat surfaces 42 and 43 terminated with semicylindrical surfaces 44 and 45. In this embodiment, the retaining bolt 34 of a circular cross section has two opposite flat surfaces 46 and 47 of a length x. The distance between the flattened surfaces 46 and 47 corresponds to the width of the oblong hole 33 so that the form 16 is slidably guided in contact with the flattened surfaces of the bolt. Approximately midway of the flattened surfaces, vertical grooves are provided for receiving respective sealing strips 48 and 49. Two axially directed channels 50 and 51 are provided in the bolt 34 to open into opposite curved sides 52 and 53 of the bolt. These channels 50 and 51 can be directed either downwardly or, as indicated by dashed lines, they can be directed into the upper face of the bolt 34.

A cover plate **53*a* sealingly engages the top surface of form 16 to cover the oblong hole 33 and also sealingly surrounds the projecting end part of the bolt 34**. As seen from FIG. 9, both the bending table 54 and the bending form 16 have facing recesses for receiving an arresting key 55, preferably in the form of a matching spring which ensures that the bending form 16 during its angular displacement is always arrested in the desired working position. During the rotation of the form 16 by means of the retaining bolt 34, the arresting spring 55 is lowered by means of a hydraulically operated cylinder-and-piston unit 56, 57.

The arresting key 55 is oriented in the direction of the oblong hole 33 so that in shifting the form 16 the latter is guided by the arresting key 55. This guidance, however, can be performed by the flattened surfaces 46, 47 of the bolt 34 without the aid of the arresting key 55. For this purpose, the bolt is rotated in an exact manner, to be explained below, and arrested in its desired angular position by means of stops or a lock bolt, for example.

A pneumatic shifting of the form as shown in FIG. 8 is effected in the following manner; If pressurized air is admitted through channel 51 and opening 53 into the left-hand pressure space 45 of the oblong hole, and the opposite pressure space 42 is pressure-relieved through opening 52 and channel 50, then the entire bending form is moved in the direction of arrow 48 until the semicylindrical end 44 of the hole 33 abuts against the opposite surface of the bolt 34. Shifting movement in opposite direction is introduced by reversing the feeding of pressure air through channel 50 and opening 52 into the pressure space 42 and pressure-relieving the space 45 through the channel 51. This control of pressurized air is accomplished by a conventional control valve. From FIGS. 8 and 9, it is evident that, due to substantially air-tight sealing of the oblong hole 33 in the shiftable form 16 by means of cover plate 53*a* and by the upper surface of bending table 54, and due to the sealing effect of flattened surfaces 46, 47 of the retaining bolt 34, the whole combination operates as a pneumatic cylinder-and-piston unit in which the bolt 34 is a stationary piston and bending form 16 is a movable cylinder. Air-leakage problems are negligible inasmuch as the arresting spring 55 can be accurately machined to match its recesses in the table 54 and form 16, and minute amounts of leaking air have no detrimental effect on the shifting operation. Pressurized air is employed for the displacement of the bending form only and is not applied during the bending process, inasmuch as upon completion of the shifting of the form the latter is locked to the bending table by the movable arresting spring 55 which, in a partially raised position, permits the shifting movement of the form in the direction of oblong hole 33, and upon completion of this shifting movement the spring 55 is fully raised to arrest the form 16 not only against rotation but also against any shifting movement. Evidently, there can also be used other suitable locking means, for example pneumatically or hydraulically controlled locking bolts, and the like.

Figure 10:
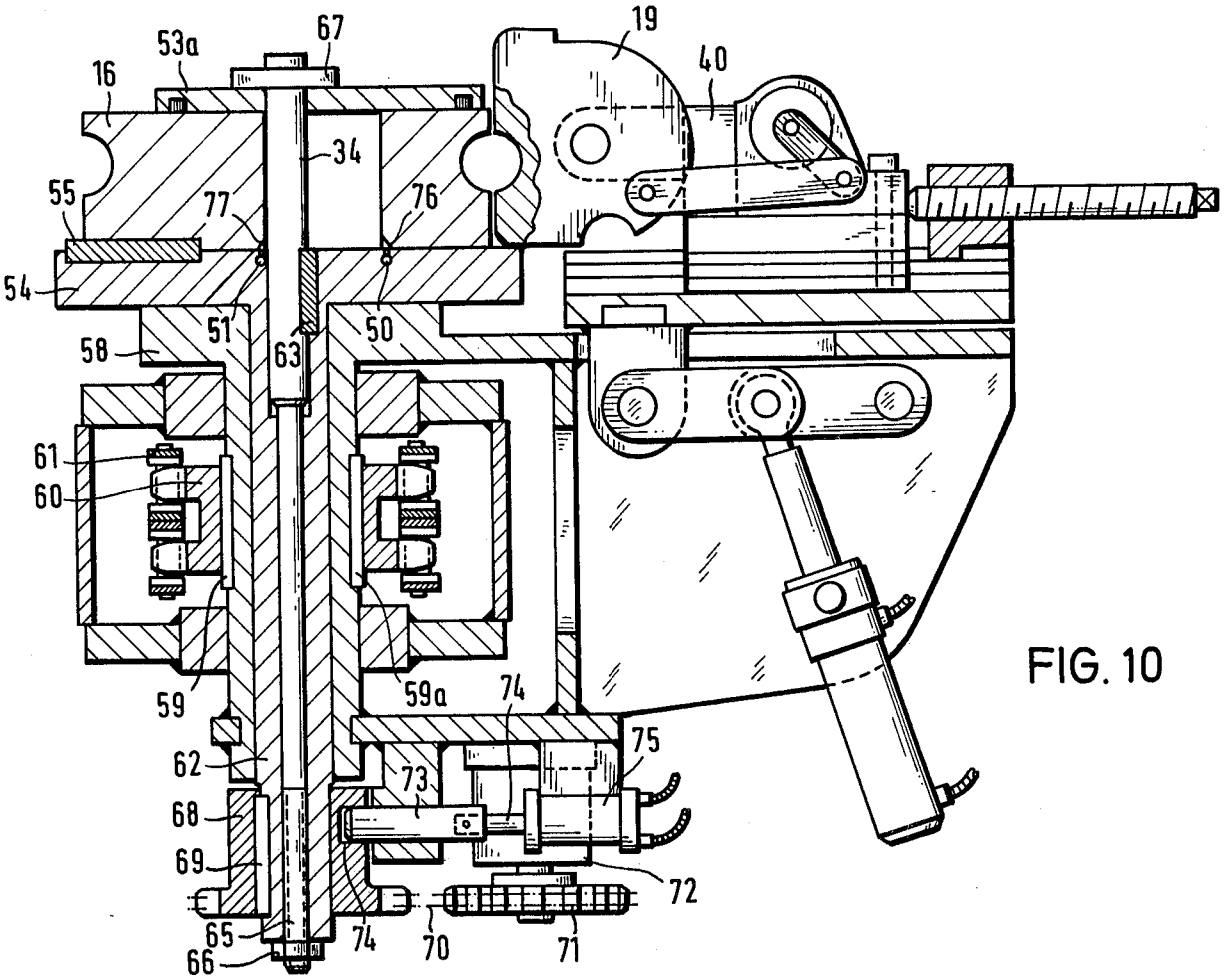
FIG. 10 is a side view, partly in section, of a bending table in connection with a bending form and a clamping jaw, and with the assigned driving means.

FIG. 10 illustrates a part of the bending table with a clamping jaw 19 which is rotatably mounted on axle 40 and movable back and forth relative to bending form 16 by a crank mechanism in the same manner as disclosed in the aforementioned German publication No. 26 26 202. Bending form 16 is of the type disclosed in FIG. 9 and is secured against rotation during its shifting movement by a key 55 recessed in the bending table 54 in the direction of oblong hole 33. The bending table is integrally connected to a hollow shaft 62 which is rotatable in a bushing 58. The bushing 58 is keyed by keys 59 and 59*a* to spur gear 60 driven in a known manner by a chain 61 which thus rotates the whole bending table assembly. The hollow shaft 62 receives the retaining bolt 34, which is connected for joint rotation with the bending table 54 and its shaft 62 by a key 63. The lower part of retaining bolt 34 is extended in the form of a threaded rod 65 and the upper end of bolt 34 rests on the upper surface of cover plate 53*a* by means of a wedge 67 and pressure exerted against the cover plate 53*a* is adjusted by means of a screw nut 66 engaging the opposite lower end of the rod 65. Separation line between the lower surface of cover plate 53*a* and the upper surface of bending form 16 is further protected against leakage by a peripheral sealing strip surrounding the oblong hole 33, as disclosed in FIG. 9.

The lower end of hollow shaft 62 is connected to a spur gear 68 driven by means of a chain 70 and pinion 71 of an electric motor 72. Motor 72 thus rotates via the hollow shaft 62 and the key 63 the bolt 34 which in turn rotates (when key 55 is lowered) the bending form 16 from its position according to FIG. 6 into the position according to FIG. 7. Bending form 16 is arrested in the adjusted angular position by means of a locking pin 73 engaging a bore in the spur gear 68 and being controlled by means of a hydraulic cylinder-and-piston 74, 75. This rotary movement of the bending form, imparted by means of a rotary drive 69–72 which is coaxial with the rotary drive 60, 61 for the entire bending table assembly, is applicable also for the preceding embodiments shown in FIGS. 7–9. The pneumatic channels 50 and 51, instead of being formed in the retaining bolt 34, in the embodiment according to FIG. 10 are made in the bending table 54 and are spaced apart from each other about the length of the oblong hole 33. It is of advantage when the lower edges of the oblong hole in the range of the mouths of the channels 50 and 51 are slanted to form inlet and outlet guides for the pressurized air.

It will be understood that each of the elements described above, or two or more together, may also find a useful application in other types of constructions differing from the types described above.

While the invention has been illustrated and described as embodied in a pipe-bending machine provided with a bending form having two curved surfaces, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A pipe-bending machine comprising a stand, a bending table supported for rotation relative to the stand, an adapter sleeve for clamping a portion of the processed pipe, a sliding carriage mounted for free reciprocating movement on the stand and connected to the adapter sleeve, a bending form mounted on an upper surface of said bending table and having at least two curved peripheral sections each defining a center of its curvature, the form being shiftable on said upper surface of said bending table in a radial direction relative to the axis of rotation of the table, from a first working position in which the axis of rotation of the table coincides with one center of curvature of the form into another working position in which the axis of rotation of the table coincides with the other center of curvature of the form, means for arresting the form in the selected working position, and clamping means arranged on the bending table for movement against the selected peripheral section of the bending form to clamp a portion of the pipe to be bent.

2. A pipe-bending machine as defined in claim 1, having two opposite curved peripheral sections of different radii of curvature, said sections being formed with semicircular grooves matching the diameter of processed pipes, and said clamping means being formed with semicircular grooves.

3. A pipe-bending machine comprising a stand, a bending table supported for rotation relative to the stand, an adapter sleeve for clamping a portion of the processed pipe, a sliding carriage mounted for free reciprocating movement on the stand and connected to the adapter sleeve, a bending form mounted on an upper surface of said bending table and having at least two curved peripheral sections each defining a center of its curvature, the form being shiftable on said upper surface of said bending table from a first working position in which the axis of rotation of the table coincides with one center of curvature of the form into another working position in which the axis of rotation of the table coincides with the other center of curvature of the form, means for arresting the form in the selected working position, clamping means arranged on the bending table for movement against the selected peripheral section of the bending form to clamp a portion of the pipe to be bent, and a retaining bolt coaxial with the axis of rotation of the bending table and projecting above the upper surface of the latter, said bending form being provided with an oblong hole connecting said centers of curvature of its peripheral sections, said bolt projecting into said oblong hole to guide the shifting movement of the form between its respective working positions.

4. A pipe-bending machine as defined in claim 3, further including hydraulic or pneumatic means for controlling the shifting movement of the bending form between its working positions.

5. A pipe-bending machine as defined in claim 4, wherein said hydraulic or pneumatic means includes a cover plate slidably engaging the upper surface of the bending form in the range of the oblong hole, said retaining bolt sealingly engaging opposite walls of said oblong hole to divide the latter into separate pressure spaces, and conduits for feeding or discharging a pressure medium into the pressure spaces so that the retaining bolt acts as a stationary piston and the bending form acts as a movable cylinder.

6. A pipe-bending machine as defined in claim 5, wherein parts of the retaining bolt which engage the opposite walls of the oblong hole are flattened to act as guiding surfaces for directing the shifting movement of the form along the opposite walls of the oblong hole, and alternatively to impart a rotary movement to the form.

7. A pipe-bending machine as defined in claim 6, wherein said retaining bolt is coupled to a rotary drive for imparting the rotary movement to the bending form.

8. A pipe-bending machine as defined in claim 7, wherein said rotary drive includes a hollow shaft rigidly connected to the bending table and being coaxial with the axis of rotation of the latter, a spur gear connected to the hollow shaft and driven by a chain drive which is mounted on the bending table.

9. A pipe-bending machine as defined in claim 8, comprising retractable arresting means between the bending table and the bending form, said arresting means being in the form of a recessed key extending parallel to the elongation of the oblong hole and parallel to the flattened surfaces in the retaining bolt to assist in the guidance of the form during its shifting movement.

10. A pipe-bending machine as defined in claim 9, further including hydraulic control means coupled to the arresting key to retract the same into the bending table when the bending form is rotated by the bolt.

11. A pipe-bending machine as defined in claim 5, further including two pneumatic channels formed in the retaining bolt, one of said channels opening into one of the pressure spaces, and the other channel opening in the other pressure space.

12. A pipe-bending machine as defined in claim 10, further including sealing means for sealing the interfaces between the flattened sides of the retaining bolt and the corresponding surfaces of the oblong hole and to seal the contact surfaces between said cover plate and the upper surface of said bending form.

* * * * *